US006578208B1

(12) United States Patent
Lytle

(10) Patent No.: US 6,578,208 B1
(45) Date of Patent: Jun. 17, 2003

(54) SWIMMING POOL SKIMMER CLOSURE ASSEMBLY

(76) Inventor: David Bruce Lytle, 920 N. Pike Rd., P.O. Box 8, Cabot, PA (US) 16023

( * ) Notice: Subject to any disclaimer, the term of this patent is extended or adjusted under 35 U.S.C. 154(b) by 0 days.

(21) Appl. No.: 10/127,996

(22) Filed: Apr. 24, 2002

(51) Int. Cl.[7] ..... E04H 4/14
(52) U.S. Cl. ..... 4/507; 4/496
(58) Field of Search ..... 4/295, 496, 504, 4/506, 507; 210/169, 242.1, 416.2

(56) References Cited

U.S. PATENT DOCUMENTS 3,733,621 A * 5/1973 Jannuzzi, Jr. ..... 4/506
4,281,422 A 8/1981 Simonelli
4,368,550 A * 1/1983 Stevens ..... 4/507
4,561,134 A * 12/1985 Mathews et al. ..... 4/496
4,825,605 A 5/1989 Weir
4,903,351 A 2/1990 Dengel et al.
4,913,810 A 4/1990 Hodak
5,115,554 A * 5/1992 Fell, Sr. ..... 4/295 X
5,285,538 A 2/1994 Hodak
5,604,939 A * 2/1997 Widener ..... 4/507

* cited by examiner

*Primary Examiner*—Robert M. Fetsuga
(74) *Attorney, Agent, or Firm*—Aileen Champion Addessi

(57) ABSTRACT

A skimmer pool closure assembly for closing off a swimming pool from a pool skimmer that is mounted to the pool adjacent a side wall opening includes a face plate attachable to either the pool skimmer or the side wall and having a configuration generally coextensive with the side wall opening. The face plate has a centrally located opening for registration with the side wall opening and pool skimmer. The skimmer pool closure assembly includes a hatch cover removably and threadedly securable to the face plate and is sized to snugly fit within or about the face plate opening for preventing water from entering the skimmer. The hatch cover includes a tool receiving slot for enabling a person to install and remove the hatch cover from the face plate. Alternatively, a safety insert may be threadedly secured to the face plate for selectively allowing items and water into the skimmer.

20 Claims, 3 Drawing Sheets

SWIMMING POOL SKIMMER CLOSURE ASSEMBLY

BACKGROUND OF THE INVENTION

The present invention pertains to closure assemblies and systems for facilitating swimming pool maintenance and, more particularly, pertains to a swimming pool closure assembly for closing off a swimming pool skimmer from a swimming pool for upkeep, maintenance, repair, winter shutdown and spring/summer opening.

The popularity and ownership of private, residential swimming pools has risen in recent years as more and more homeowners have opted for the convenience, safety, ready availability and flexibility in use of both above ground and in ground swimming pools. As the popularity of residential swimming pools has increased, their breadth of design and the range of enhancements and accessories has expanded.

For example, both in ground and above ground pools currently are available in a variety of depths, shapes, and sizes. A residential swimming pool requires considerable upkeep and maintenance as appropriate chlorine levels must be maintained, filtration equipment must be monitored and cleaned, and debris, such as leaves, grass, and twigs, must be removed either manually by hand-held nets and pool vacuums or mechanically by filtration equipment operating in conjunction with the swimming pool skimmer structure that is mounted to the side wall of the swimming pool.

Swimming pools generally have a port opening formed in the upper portion on one side wall and to which the swimming pool skimmer structure is mounted in sealed registration therewith so that pool water can flow from the swimming pool through the port opening and then into the pool skimmer structure. The pool skimmer structure is a container-like structure and has at least one conduit extending from it for connection to the filtration equipment so that pool water can be continuously directed from the pool skimmer structure into and through the filtration equipment whereupon the filtered pool water is returned to the swimming pool by a return conduit that is in sealed registration with a pool water return port opening formed on the side wall at some distance from the skimmer opening. Depending on the type of swimming pool design, the pool skimmer structure can either be mounted directly to the external surface of the pool side wall; or the pool skimmer structure can include a throat portion that partially projects through the upper port opening of the pool side wall and sealably attaches to the interior surface of the side wall by a lip or flange that surrounds the upper port opening. However, the pool skimmer structure is permanently secured to the pool side wall, and thus cannot be removed for swimming pool maintenance, upkeep or the yearly swimming pool opening and closing procedures.

When performing pool maintenance, the port opening connecting the swimming pool to the pool skimmer structure must be closed off to minimize or prevent the loss of pool water. In addition, in cold climates, when closing down the swimming pool, the port opening must be closed to prevent pool water from flowing into the filtration equipment and damaging the filtration equipment when the pool water freezes.

A variety of swimming pool sealing and closure assemblies and systems have been developed to close off the opening between the swimming pool and the pool skimmer structure.

For example, Simonelli (U.S. Pat. No. 4,281,422) discloses a winterizing kit that includes a socket plug that fits into a female receptacle of a filtered water inlet. However, the socket plug includes a check valve and nipple to impede the flow of water from the swimming pool and also to disconnect the air compressor attached to the pool water line.

Weir (U.S. Pat. No. 4,825,605) discloses a closure device for pre-formed wall openings in swimming pool side wall panels that includes the insertion of either rectangular or circular-shaped plugs into the wall openings. However, since the plugs are used to close unwanted openings in the wall of the swimming pool, the plugs are fixedly secured to the side wall of the pool.

Dengel et al. (U.S. Pat. No. 4,903,351) discloses a winterizing faceplate kit for the side wall of a swimming pool, and the kit includes a cover plate, a face plate, and a pair of gaskets, with the cover plate being the element adapted for removable securement to the side wall to facilitate spring opening and fall closure of the swimming pool.

Hodak (U.S. Pat. No. 4,913,810) discloses a skimmer apparatus sealing and closure assembly similar to Dengel's kit and which includes a gasket frame, a faceplate, and a cover panel all attachable to the inside surface of the pool wall for closing off the water flow from the swimming pool to the skimmer apparatus.

Hodak (U.S. Pat. No. 5,285,538) discloses a sealing assembly similar in structure and function to Dengel and Hodak's assemblies and which includes a face plate and a flexible cover element securable to the inside surface of the swimming pool side wall. However, the cover plates of Dengal and Hodak may be not durable over an extended period of time.

Therefore, what is needed is a sealing or closure assembly that is durable, easy to install, provides an impermeable barrier between the swimming pool and the pool skimmer apparatus, and does not hinder daily or weekly pool maintenance during the summer use season.

SUMMARY OF THE INVENTION

The present invention is for use in conjunction with a skimmer mounting plate and a swimming pool skimmer and, more particularly, includes a swimming pool closure assembly for selectively closing off the swimming from pool skimmer during periods of maintenance and non-use or winterizing.

A skimmer pool closure assembly includes a face plate adapted for removable securement to the skimmer mounting plate and the side wall of the swimming pool adjacent the side wall opening. The face plate has a configuration generally coextensive with the side wall opening in order to completely cover the side wall opening of the swimming pool. The face plate includes a first side wall surface that is disposed adjacent to the swimming pool side wall, and second pool chamber surface that faces inwardly toward the swimming pool, and a centrally located face plate opening that registers with the side wall opening of the swimming pool side wall. The face plate opening also includes a threaded portion, and spaced along the peripheral border of the face plate are a plurality of fastener apertures. The apertures of the face plate align with pre-formed holes in the skimmer mounting plate thus allowing the use of bolts or screws to secure the face plate to the skimmer mounting plate.

The skimmer pool closure assembly also includes a disc-shaped hatch cover that is adapted for removable securement to the face plate in order to close off the face plate opening thereby preventing pool water from entering the swimming pool skimmer. More specifically, the hatch cover includes hatch cover threads that are capable of mateable engagement to the threaded portion of the face plate opening, and a tool receiving slot for assisting the pool owner in tightening the hatch cover onto the face plate and for removing the hatch cover from the face plate. Also, at least one sealing member can be placed on the hatch cover threads to enhance the sealing ability of the hatch cover when the hatch cover is disposed within the face plate opening for securement to the face plate.

In order to augment the seal between the face plate and the skimmer mounting plate, the face plate may include a channel or, alternatively, two spaced-apart raised beads that extend continuously along the face plate adjacent to the peripheral border. The fastener apertures of the face plate may be located between the raised beads.

It is an objective of the present invention to provide a skimmer pool closure assembly that is durable, lightweight, and easy to attach and remove from the skimmer mounting plate.

It is another objective of the present invention to provide a skimmer pool closure assembly that effectively seals off the opening in the swimming pool side wall to thus prevent pool water from entering the swimming pool skimmer.

Yet another objective of the present invention is to provide a skimmer pool closure assembly that can be used with swimming pool skimmers and skimmer mounting plates incorporating a variety of different designs and configurations.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DETAILED DESCRIPTION OF THE PREFFERED EMBODIMENT

Figure 1:
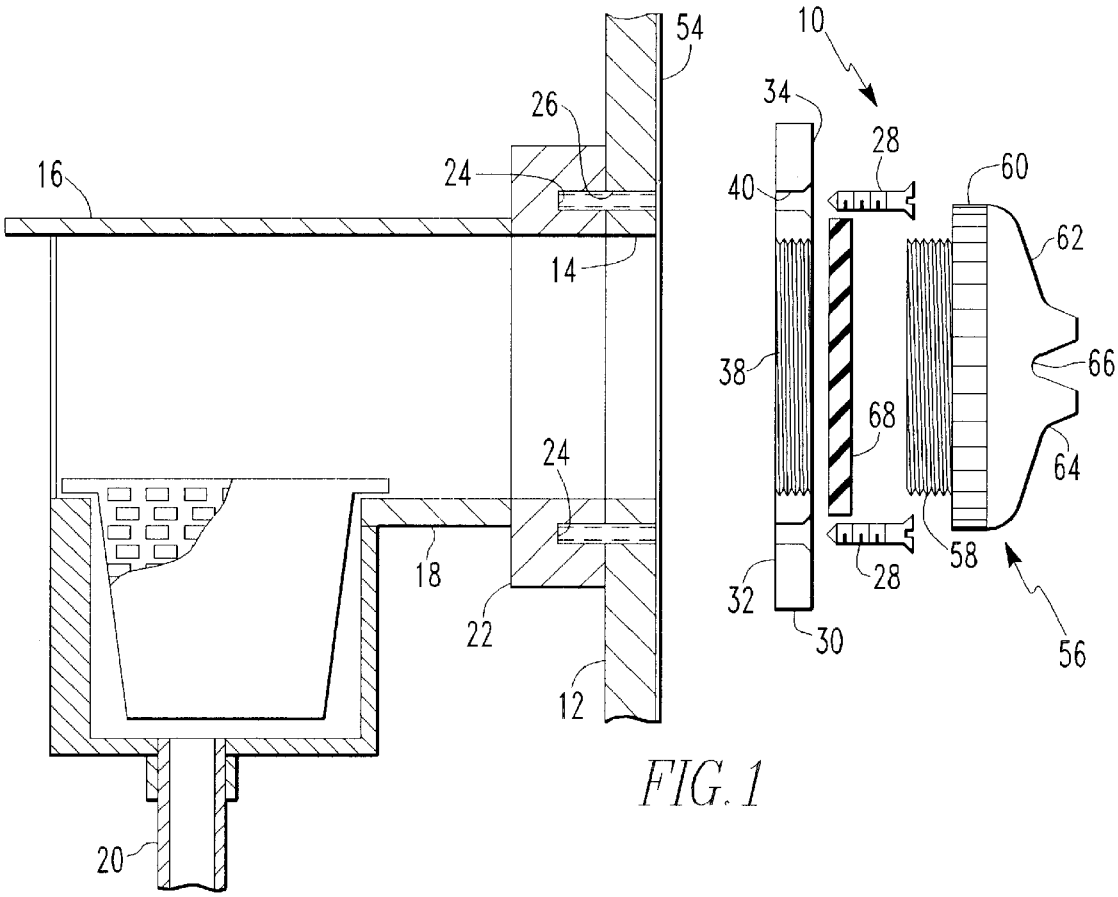
FIG. 1 is a side elevational view of a swimming pool skimmer closure assembly, a side wall of a swimming pool, and a skimmer device.
Figure 2:
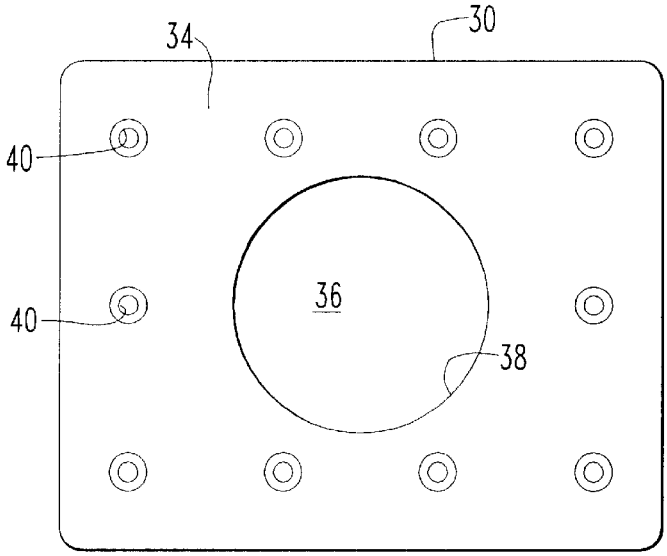
FIG. 2 is a front elevational view of a face plate of the present invention first shown in FIG. 1.

Referring to FIGS. 1–9, a swimming pool skimmer closure assembly 10 for above ground and in ground swimming pools is shown. A typical swimming pool has a side wall 12 with a side wall opening 14 located near the upper edge of the side wall 12. Mounted to the exterior of the swimming pool side wall 12 is a swimming pool skimmer 16. The swimming pool skimmer 16 includes a box-like passageway or throat portion 18 that is in sealed registration with the side wall opening 14 so that during normal operation of the swimming pool, pool water will flow through the side wall opening 14 and through the throat portion 18, and then into the swimming pool skimmer 16. The pool water will then flow through a conduit 20 connected at the bottom of the swimming pool skimmer 16 and then into filtration equipment (not shown) whereupon the water will be returned to the swimming pool by a return conduit (not shown) that registers with the swimming pool side wall 12 at a lower position and some distance from the side wall opening 14 that is in flow communication with the swimming pool skimmer 16.

The swimming pool skimmer 16 is secured to the side wall 12 of the swimming pool by a skimmer mounting plate 22 that includes spaced-apart mounting holes 24 that align with holes 26 in the side wall 12 adjacent the side wall opening 14 so that fasteners 28 can be inserted therethrough for attaching the mounting plate 22 to the side wall 12. U.S. Pat. Nos. 4,913,810 and 5,285,538 disclose common swimming pool skimmer and skimmer mounting plate structures that mount to the exterior surface of the swimming pool side wall. U.S. Pat. No. 4,913,810 also discloses standard filtration equipment, and both patents are incorporated by reference herein. However, because swimming pools come in varying makes and designs, the throat portion of some swimming pool skimmers may slightly extend through the side wall opening so that the skimmer mounting plate attaches to the interior surface of the swimming pool side wall by a lip or flange that surrounds the side wall opening. The lip or flange of this type of skimmer mounting plate would include mounting holes that align with the holes in the side wall. The swimming pool closure assembly 10 of the present invention is adaptable to the various types of swimming pool skimmer and skimmer mounting plate designs for closing off the side wall opening of the swimming pool to facilitate periodic swimming pool maintenance and for closing off the side wall opening to prevent pool water from entering and damaging the filtration equipment during seasonal swimming pool shutdown.

As shown in FIG. 1, the swimming pool skimmer closure assembly 10 of the present invention includes a mounting or face plate 30 that is removably securable to the side wall 12 of the swimming pool adjacent the side wall opening 14. The face plate 30 is generally rectangular-shaped and has a configuration that is coextensive with the side wall opening 14. The face plate 30 includes a first side wall surface or pool skimmer surface 32 that faces and is mounted to or against either the swimming pool side wall 12 or the skimmer mounting plate 22 when the face plate 30 is disposed in its operative position. The face plate 30 also includes an opposite second pool chamber side 34 that faces the swimming pool, and a circular-shaped central opening 36 for registration with the side wall opening 14 so that pool water can flow therethrough and into the swimming pool skimmer 16.

Figure 4:
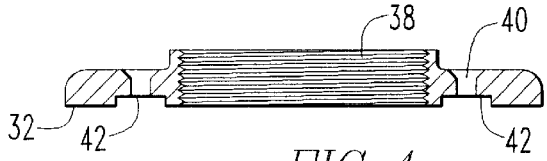
FIG. 4 is a side elevational view of an alternative embodiment for the face plate.
Figure 6:
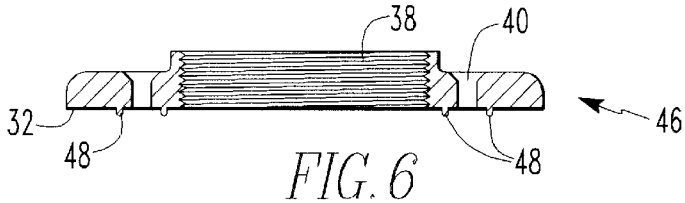
FIG. 6 is a side elevational view of the face plate shown in FIG. 5.
Figure 9:
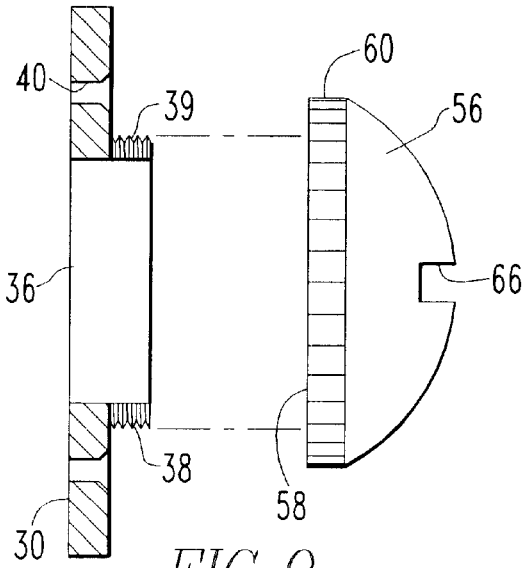
FIG. 9 is a side elevational view of an alternative embodiment of the face plate and the hatch cover.

The central opening 36 is circumscribed or delimited by a threaded portion or, more specifically, a plurality of annular face plate threads 38. The face plate threads 38 may be inside diameter threads as illustrated in FIGS. 1, 4 and 6, or alternatively, may be outside diameter threads as illustrated in FIG. 9. The inside diameter threads are positioned within the opening 36. The outside diameter threads are positioned about an extended portion 39 of the opening 36.

Located adjacent to the peripheral edge or border of the face plate 30, and may be spaced equidistant to one another therealong, are a plurality of fastener apertures 40. The fastener apertures 40 of the face plate 30 are spaced to align with the mounting or through holes 24 and 26 of the skimmer mounting plate 22 and/or the side wall 12 of the swimming pool to facilitate the securement of the face plate 30 to the swimming pool side wall 12 by passing or inserting fasteners 28, such as bolts, screws, or the like, through the fastener apertures 40 and the respective mounting or through holes 24 and 26. The fasteners 28 may be flush with the surface 34 or may be countersunk within the face plate 30.

As one example, the face plate 30 may be constructed of a ¼" thick or thicker rectangular metal plate with the hole 36 having a 6" diameter. Alternatively, any suitable material may be used to construct the face plate 30, such as plastic, nylon, a composite material, or the like. Also, as an alternative to the rectangular shape that the face plate 30 may have, the face plate 30 may have any suitable shape for accommodating various designs of pool skimmers.

Although in the preferred embodiment of the invention both the side wall surface 32 and the pool skimmer surface 34 of the face plate 30 are flat surfaces, slight modifications to the configuration of the side wall surface 32 of the face plate 30 may be contemplated in order to accommodate the various designs of pool skimmers and skimmer mounting plates.

For example, in FIG. 4, the face plate 30 includes a continuous channel 42 that extends along the side wall surface 32 adjacent the peripheral border. The fastener apertures 40 may be aligned within the channel 42 or alternatively, may be positioned inside of the channel 42. The channel 42 or recess enhances the sealable registration of the face plate 46 to or against the inside surface of the side wall 12 or against the liner 54 of the swimming pool.

Figure 5:
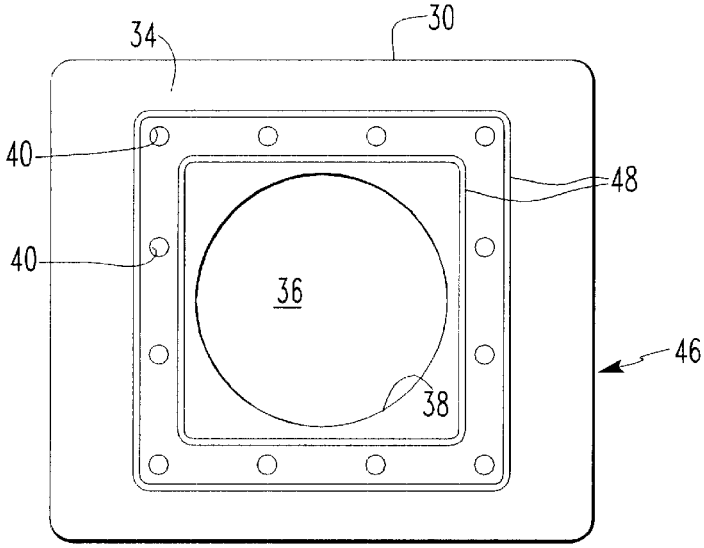
FIG. 5 is a back elevational view of another alternative embodiment for the face plate.

In addition, another configuration of a face plate 46 is shown in FIGS. 5 and 6. The face plate 46 of this configuration includes a pair of spaced-apart ridges or raised beads 48 that extend continuously along the side wall surface 32 adjacent the peripheral border of the face plate 46. The face plate 46 may or may not have a continuous slot formed between the raised beads or ridges 48. This modification also enhances the sealable registration of the face plate 46 to or against the inside surface of the side wall 12 or against the liner 54 of the swimming pool.

As an alternative, if the face plates 30 or 46 are not positioned directly against the liner 54, depending on the design of the particular swimming pool skimmer, then a gasket (not shown) may be placed between the face plate 30 or 46 and the skimmer mounting plate 22.

Figure 3:
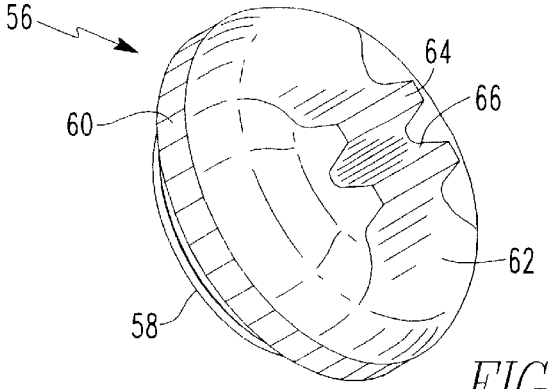
FIG. 3 is an isometric view of a hatch cover of the present invention first shown in FIG. 1.

As illustrated in FIGS. 1 and 3, the other major structural component of the swimming pool closure assembly 10 of the present invention is a hatch cover 56. The hatch cover 56 is disc or circular-shaped, or alternatively, may be square shaped, rectangular, or any suitable shape. The hatch cover 56 is sized for sealable registration within the central opening 36 of the face plate 30, and includes a second threaded portion having annular hatch cover threads 58 for mateable engagement to the annular threads 38 of the central opening 36 of the face plate 30. The hatch cover threads 58 may be outside diameter threads as illustrated in FIGS. 1 and 3, or alternatively, may be inside diameter threads as illustrated in FIG. 9. The outside diameter threads are positioned about an extended portion of the hatch cover 56. The inside diameter threads are positioned within the hatch cover 56.

The hatch cover 56 also includes a notched or knurled rim 60 for assisting the pool owner in gripping the hatch cover 56 when tightening the hatch cover 56 on the face plate 30 and for loosening and removing the hatch cover 56 from the face plate 30. In addition, the hatch cover 56 also includes a tool engagement surface 62 opposite the threaded portion, and integrally formed on the tool engagement surface 62 are a pair of crests 64 defining a longitudinally extending tool receiving slot 66. A tool, such as a flat head screwdriver, rod type tool, or the like, can be placed in the tool receiving slot 66 for providing the pool owner with additional leverage when tightening the hatch cover 56 on the face plate 30 or removing the hatch cover 56 from the face plate 30. The hatch cover 56 may be formed of metal, plastic, nylon, a composite material, or any other suitable material.

Furthermore, as shown in FIG. 1, one or more sealing members 68, such as flexible O-rings, can be placed on the threaded portion of the hatch cover 56 to augment the sealable securement of the hatch cover 56 to the face plate 30 and to provide an impervious boundary between the annular threads 38 of the central opening 36 of the face plate 30 and the second threaded portion of the hatch cover 56. The O-ring 68 may be formed of a rubber gasket or any other suitable type of material.

Figure 7:
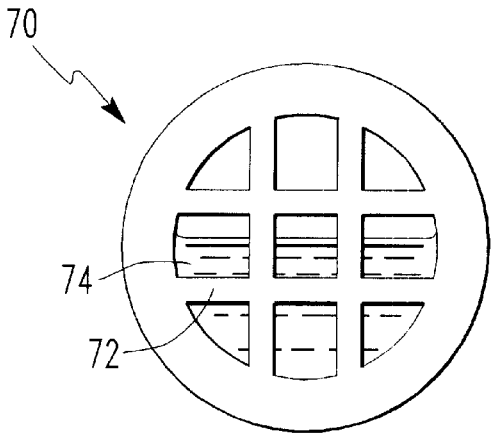
FIG. 7 is a front elevational view of a safety insert threadable into the face plate.
Figure 8:
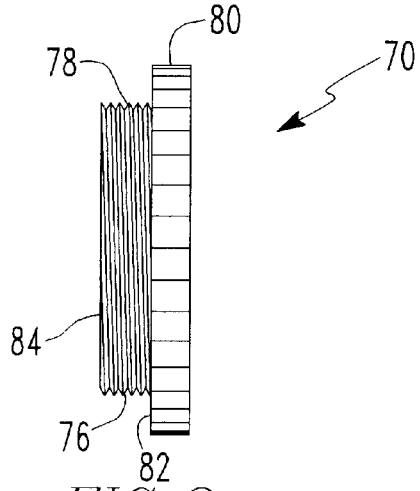
FIG. 8 is a side elevational view of the safety insert.

During use of the swimming pool, a safety insert 70 may be threadedly attached to the face plate 30. The safety insert 70 includes a mesh portion 72 having a plurality of safety bars and openings 74. The mesh portion 72 prevents children's hands, toys, floating thermometers, small animals, and other items from entering into the skimmer 16. The openings 74 allow water, bugs, and other debris to enter into the skimmer 16. The safety insert 70 has a threaded portion 76, which may have outside diameter threads as illustrated in FIGS. 7 and 8, or alternatively, may have inside diameter threads, for mateable engagement with the threaded portion of the face plate 30. The outside diameter threads of the threaded portion 76 are positioned about an extended portion 78 and adjacent to a flange 80 having a shoulder 82. The shoulder 82 acts as a stop to prevent the insert 70 from being threaded too far. As an alternative, inside diameter threads of the threaded portion 76 could be positioned within the extended portion 78. An opening 84 is disposed through the extended portion 78 for registration with the side wall opening 14 so the pool water can flow therethrough and into the swimming pool skimmer 16.

In operation, during use of the swimming pool, the swimming pool skimmer 16 is mounted to the exterior surface of the pool side wall 12 by the skimmer mounting plate 22 so that the throat 18 of the swimming pool skimmer 16 registers with the side wall opening 14. The mounting holes 24 of the skimmer mounting plate 22 align with holes 26 in the side wall 12 of the swimming pool. Contiguously disposed against the interior surface of the swimming pool side wall 12 is the pool liner 54 with provision being made for the impervious sealed fitting of the pool liner 54 about the side wall opening 14. The face plate 30 is aligned with the skimmer mounting plate 22 and secured thereto by the insertion of fasteners 28, such as bolts or screws, through the fastener apertures 40 of the face plate 30 and through the aligned bolt holes 26 and 24 of both the swimming pool side wall 12 and the skimmer mounting plate 22. The safety insert 70 may be threadedly attached to the face plate 30.

To close the swimming pool skimmer 16 during non-use of the swimming pool, the safety insert 70 can be removed and the hatch cover 56 can then be threaded into or about the central opening 36 of the face plate 30 and tightened against the annular threads 38 of the central opening 36 thereby sealing and closing the central opening 36 and preventing pool water from flowing into the swimming pool skimmer 22.

An advantage of the swimming pool skimmer closure assembly 10 is that the hatch cover 56 is extremely durable and can be used and reused to close off the swimming pool from the swimming pool skimmer 16 for a number of successive winter shutdown seasons or during periods of maintenance and upkeep.

Another advantage of the swimming pool skimmer closure assembly 10 is that the face plate 30 or 46 and the hatch cover 56 may be installed on an existing swimming pool skimmer.

Yet another advantage of the swimming pool skimmer closure assembly 10 is that the safety insert 70 can be attached to the face plate 30 for preventing children's hands, toys and small animals from becoming trapped within the skimmer 16, while at the same time allowing water, bugs and debris into the skimmer 16.

Thus there has been shown and described a novel swimming pool skimmer closure assembly which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A pool skimmer closure assembly for use with a swimming pool having a swimming pool skimmer mounted to a side wall opening in the side wall of the swimming pool by a skimmer mounting plate and the swimming pool skimmer being in flow communication with pool water through the side wall opening, the pool skimmer closure assembly, comprising:

a face plate having a first side wall surface, an opposite second pool surface, a face plate opening sized and positioned for alignment with the side wall opening so that pool water can flow therethrough and into the swimming pool skimmer, a peripheral border circumjacent the face plate opening and having a plurality of fastener apertures spaced from each other along the peripheral border;

the face plate opening having a first threaded portion;

a hatch cover having a second threaded portion for mateable engagement to the first threaded portion of the face plate opening for selective removable securement to the face plate; and the face plate adapted for removable securement to the skimmer mounting plate whereupon the hatch cover can be selectively attached to the face plate for securement to the face plate during periods of swimming pool non-use to prevent pool water from entering the swimming pool skimmer and selectively removed from the face plate opening of the face plate for periods of swimming pool use thus allowing swimming pool water to flow from the pool and into the swimming pool skimmer.

2. The pool skimmer closure assembly according to claim 1, wherein:

the first threaded portion of the face plate is positioned within the face plate opening; and the second threaded portion of the hatch cover is outside diameter threads for insertion of the hatch cover within the face plate opening.

3. The pool skimmer closure assembly according to claim 1, wherein:

the first threaded portion of the face plate is positioned about the face plate opening; and the second threaded portion of the hatch cover is positioned within the hatch cover for disposition of the hatch cover about the face plate opening.

4. The pool skimmer closure assembly according to claim 1, further comprising a safety insert having a threaded portion for mateable engagement to the first threaded portion of the face plate opening, the safety insert having a mesh portion with openings for preventing selective items from entering the skimmer while allowing water and other items to enter into the skimmer.

5. The pool skimmer closure assembly according to claim 1, wherein the hatch cover includes an annular knurled rim and a longitudinally extending tool receiving slot.

6. The pool skimmer closure assembly according to claim 1, further comprising at least one sealing member for disposition on the second threaded portion of the hatch cover for forming a substantially impervious boundary between the hatch cover and the face plate when the hatch cover is secured to the face plate.

7. The pool skimmer closure assembly according to claim 1, wherein the wall surface of the face plate includes a channel which extends continuously about the face plate opening in the face plate.

8. The pool skimmer closure assembly according to claim 1, wherein the wall surface of the face plate includes a pair of spaced-apart ridges extending continuously along the peripheral border of the wall surface side of the face plate for providing a sealable securement of the face plate to the swimming pool side wall.

9. The pool skimmer closure assembly according to claim 1, further comprising:

the skimmer mounting plate having a plurality of apertures;

the plurality of fastener apertures of the face plate positioned in alignment with the plurality of apertures of the skimmer mounting plate; and a plurality of fasteners for disposition within the plurality of fastener apertures of the face plate and within the aligned apertures of the skimmer mounting plate for securing together the skimmer mounting plate and the face plate.

10. The pool skimmer closure assembly according to claim 1, wherein the face plate is rectangular.

11. The pool skimmer closure assembly according to claim 1, wherein the hatch cover is disc-shaped.

12. A pool skimmer closure assembly for use with a swimming pool having a swimming pool skimmer mounted to a side wall opening in a side wall of the swimming pool by a skimmer mounting plate and the swimming pool skimmer being in flow communication with pool water through the side wall opening, the pool skimmer closure assembly, comprising:

a face plate securable to the skimmer mounting plate and having a first side wall surface, a second pool chamber surface, and a plurality of fastener apertures positioned along a peripheral border of the face plate, and the face plate having a configuration generally coextensive with the skimmer mounting plate so that the face plate can be sealably secured to the side wall of the swimming pool;

the face plate having a central opening for alignment with the side wall opening when the face plate is secured to the skimmer mounting plate, the face plate having a threaded portion;

a disc-shaped hatch cover including a threaded portion capable of mateable engagement to the threaded portion of the face plate; and at least one sealing member for placement on the threaded portion of the hatch cover for forming a seal between the hatch cover and the face plate for preventing the flow of pool water into the swimming pool skimmer when the hatch cover is secured to the face plate.

13. The pool skimmer closure assembly according to claim 12, further comprising a plurality of fasteners for disposition within the plurality of fastener apertures.

14. The pool skimmer closure assembly according to claim 12, wherein the face plate includes a channel which extends continuously about the opening in the face plate.

15. The pool skimmer closure assembly according to claim 12, wherein the face plate includes a pair of spaced-apart ridges extending continuously along the peripheral border of the pool skimmer side of the mounting plate for providing a sealable securement of the face plate to the swimming pool side wall.

16. The pool skimmer closure assembly according to claim 12, wherein the hatch cover includes an annular knurled rim.

17. The pool skimmer closure assembly according to claim 12, wherein the hatch cover includes a longitudinally extending tool receiving slot.

18. The pool skimmer closure assembly according to claim 12, further comprising a safety insert having a threaded portion for mateable engagement to the first threaded portion of the face plate opening, the safety insert having a mesh portion with openings for preventing selective items from entering the skimmer while allowing water and other items to enter into the skimmer.

19. A pool skimmer closure assembly, comprising:

a rectangular-shaped mounting plate securable to a pool skimmer mounting plate, the rectangular-shaped mounting plate having a pool skimmer side, an opposite pool chamber side and a plurality of apertures spaced along the peripheral border of the mounting plate;

the mounting plate having a cylindrical mounting plate opening and annular mounting plate threads;

a disc-shaped hatch cover for removable securement to the annular threads of the mounting plate, the hatch cover including an annular, notched peripheral rim, a tool engagement surface having a longitudinal slot integrally formed thereon, and a plurality of hatch cover threads positioned adjacent the rim and capable of being selectively engaged to the mounting plate threads so that the hatch cover can be secured to the mounting plate for closing the mounting plate opening for periods of swimming pool non-use;

an annular sealing member for slidable disposition on the annular threads of the hatch cover in order to provide a seal between the mounting plate and the hatch cover when the hatch cover is secured to the mounting plate; and a plurality of fasteners for disposition within the plurality of fastener apertures.

20. The skimmer pool closure system of claim 19, wherein the fastener apertures of the mounting plate are spaced equidistant from each other along the border of the mounting plate.

* * * * *